US006371241B1

(12) United States Patent
Yamada et al.

(10) Patent No.: US 6,371,241 B1
(45) Date of Patent: Apr. 16, 2002

(54) SPEAKER DEVICE

(75) Inventors: Teruho Yamada; Tsuyoshi Nakada; Seiji Mori, all of Tokyo; Toshikazu Iwasaki, Osaka, all of (JP)

(73) Assignees: Foster Electric Co., Ltd.; Mitsubishi Denki Kabushiki Kaisha, both of Tokyo (JP)

( * ) Notice: Subject to any disclaimer, the term of this patent is extended or adjusted under 35 U.S.C. 154(b) by 0 days.

(21) Appl. No.: 09/490,060

(22) Filed: Jan. 24, 2000

(30) Foreign Application Priority Data

Jul. 21, 1999 (JP) ..... 11-206825

(51) Int. Cl.[7] ..... G10K 9/18; G10K 9/22; D21H 15/00

(52) U.S. Cl. ..... 181/171; 162/221; 162/222; 162/224; 162/231

(58) Field of Search ..... 162/231, 221, 162/222, 224; 181/166, 167, 171, 174, 169, 148; 241/89.2

(56) References Cited

U.S. PATENT DOCUMENTS 2,244,486 A * 6/1941 Chaplin
3,946,832 A * 3/1976 Takano et al. ..... 181/167
4,221,773 A * 9/1980 Tsukagoshi et al. ..... 423/445
4,308,094 A * 12/1981 Miyoshi et al. ..... 162/218
4,352,407 A * 10/1982 Tsukagoshi et al. ..... 181/167
4,518,642 A * 5/1985 Johnston et al. ..... 428/172
5,080,743 A * 1/1992 Odajima ..... 156/243
5,455,396 A * 10/1995 Willard et al. ..... 181/172
5,521,886 A * 5/1996 Hirosawa et al. ..... 367/174
5,625,699 A 4/1997 Yamada
5,841,081 A * 11/1998 Thompson et al. ..... 181/286
5,996,727 A * 12/1999 Blind et al. ..... 181/141

FOREIGN PATENT DOCUMENTS

JP A4-373299 12/1992
JP A7-284191 10/1995

* cited by examiner

*Primary Examiner*—Peter Chin
*Assistant Examiner*—Carlos Lopez
(74) *Attorney, Agent, or Firm*—Birch, Stewart, Kolasch & Birch, LLP

(57) ABSTRACT

A speaker frame is constructed from dried paper pulp. Features in the speaker frame such as holes or slits are formed by carbonizing corresponding sections in the dried paper pulp and applying shear processing to remove the carbonized material. A carbonizing mold contains protrusions corresponding to the sections in the dried pulp to be carbonized. The result is a high quality speaker frame that is biodegradable and can be produced economically.

14 Claims, 9 Drawing Sheets

21
23
20
22
26
24

21
20
23
22

21
20
25

31
30

SPEAKER DEVICE

FIELD OF THE INVENTION

The present invention relates to a speaker which converts an electrical voice signal to a sound wave. In particular, the present invention relates to a frame for a speaker.

DESCRIPTION OF THE PRIOR ART

Up to the present time, the material used in the frames of speakers has been metal plate of which thin steel plate, press molded aluminum plate, cast products made from metallic alloys such as zinc or aluminum alloys or products made from injection molding of thermoplastic resins are examples.

For example, FIG. 11 is a cross sectional schematic view of the layout of a speaker unit using metallic plate. FIG. 12 is a front view of an example of a frame used in the speaker in FIG. 11.

In the figures, after a caulking joggle 2*a* of an upper plate 2 is inserted into a slit 1*b* formed in the lower end of the frame 1, both components are fixed by a caulking deformation process applied to the top section.

A magnet 4 is sandwiched and fixed between the upper plate 2 and the pole piece 3 by adhesive. It is noted that the magnetic circuit of the speaker is formed by the upper plate 2, the pole piece 3 and the magnet 4.

A gap termed an "air gap" 14 is formed between the upper plate 2 and the pole piece 3. A voice coil 5*a* is disposed in the gap and is wound onto a bobbin 5. The coil 5*a* generates a sound wave by creating a mechanical displacement due to an input signal and transmits the displacement to a diaphragm 8.

The voice coil 5*a* wound on the bobbin 5 is supported by a damper 10, an outer section of which is fixed to the frame 1 and by an edge 9, an outer section of which is fixed to the frame 1 in the same way. The center of the coil is arranged so that it moves in the air gap 14 without deviation. The edge 9 is fixed to and integrated with diaphragm 8. A center cap 8*a* is mounted on the diaphragm 8.

A terminal board 11 mounting terminals 12 is fixed by an eyelet or the like to the other frame 1. Reference numeral 6 denotes a gasket with the functions reinforcing the frame 1 and acting as an interface with the other mounted components.

An input signal from a terminal 12 is supplied to the voice coil 5*a* through the tinsel cord 13. 1*a* is a window, 1*d* in FIG. 12 is a strain absorption hole, 1*e* is a strain absorption notch.

Generally, metallic plate is widely used in the frames of speakers incorporated in vehicle-mounted music devices or household audio-visual devices due to their excellent qualities and low price. The disadvantage of metallic plate resides in the deterioration of sound quality in the speaker.

The reason for such a deterioration is that self-resonance in the frame is easily induced when the diaphragm of the speaker is oscillated by a sound signal. Furthermore the frequency of such self-resonance is realized in an audible frequency band. Self-resonance is caused by vibration transmitted from the outside to the speaker.

For example, the self-resonance frequency of a speaker with a 13 cm aperture using a 0.7 mm. thickness aluminum frame displays a distribution about 1.5 KHz. Frequencies in the vicinity of 1.5 KHz are faintly audible. That is to say, fidelity is reduced since vibrations of the diaphragm due to the sound signal and the vibration of the frame due to self-resonance become mixed in and are audible.

The problem of self-resonance does not particularly arise in the context of zinc cast products. However casting as a method of fabrication results in cost increases associated with the considerable secondary processing required to achieve a desired shape.

Although resin molded products display superior productivity, generally they have a low mass and share the disadvantage of metallic plate in that self-resonance results from externally applied vibrations.

The simplest method of increasing mass is to increase the thickness of the member. However when this method is applied to the frames of speakers, the outer shape increases together with increases in thickness and thus reduces freedom of disposition of the speaker and poses problems for use m cramped environments such as vehicle compartments.

The relationship of the above materials to environmental protection will be discussed below. When the product life of industrial components expires, it is needless to say that recycling of component materials or disposal with little effect on the environment is desirable. Speakers are no exception to this rule.

Up until the present time, the dismantling and reuse of metallic plate of used speakers has almost never been put into practice. For example, metallic members such as upper plates 2 are fixed strongly by a method such as caulking, adhesion or welding to the frame 1 and thus the subsequent dismantling of these components is physically difficult.

Overall processing costs are created by the processing costs, wage costs and time costs of dismantling the device. Thus even if instituted, such processes showed few economic benefits. Thus used speakers are in actuality usually disposed of in land fills and this as a result represents a waste of resources.

Disposal in land fills is not always an effective method in view of used materials. For example, resin products display extremely low decomposition over time in comparison with metal even when buried in earth or water. Needless to say, this is undesirable from the point of view of environmental protection.

In summary therefore, when molded resin or pressed metal products are used in the frame of speakers, problems with respect to acoustics result even though productivity is excellent. Cast zinc products entail problems with respect to both costs and productivity. Both such products require long periods of time to be decomposed by micro-organisms in the natural world and do not display characteristics oriented to a process of effective recycling or a method of disposal with little effect on the environment.

A known method of manufacturing paper products called fine pulp molding is used in packing containers or packing (i.e. buffer) material as a means of solving the above mentioned problems. Fine pulp molding combines molding and paper manufacturing in a type of manufacturing paper products and is a processing method which creates a three dimensional shape with high levels of accuracy with a pulp material. This method of manufacturing paper products will simply be termed fine pulp molding hereafter.

A characteristic of fine pulp molding is that it is an integrated method of paper manufacturing three dimensional shapes using a combined male-female paper making mold. Another characteristic of the molding is the external beauty of product and it is known for superior characteristics with respect to dimensional accuracy and productivity for paper products having a three dimensional shape.

In addition, the method has the advantage that apart from virgin pulp old paper, disposed paper material such as old paper may be used as material. Thus it is possible to increase the use of old paper which is perceived to create problems of oversupply in the market place and to promote recycling. On the other hand, it is possible to greatly reduce material costs and to reduce manufacturing costs.

An outline of the process of fine pulp molding will be described below. A model of the process is shown in FIG. 13.

Fine pulp molding entails three main sequential steps.

(a) Adhesion step: a male paper manufacturing mold 20 is immersed in a pulp dissolving fluid 23 and pulp is adhered to the male paper manufacturing mold 20 by vacuum suction.

(b) Dehydration/Molding step: a female paper manufacturing mold 21 is pressed onto the pulp which has adhered to the male paper manufacturing mold 20 and dehydration and molding are performed.

(c) Drying step: after pressing and drying with a heated mold onto the pulp which has been shaped by the previous step, the product (pulp mold product 25) is extracted.

Detailed description is outlined below. In FIG. 13, a male paper manufacturing mold 20 is immersed in pulp dissolving fluid 23 filling a pulp vessel 22. The paper manufacturing mold 20 forms an outer shape of the product by the mesh of a fine wire netting or the like. Furthermore the inner section of the male paper manufacturing mold 20 is connected to a vacuum pump 24 through a pipe 26.

(a) In the adhesion step, pulp is adhered to the surface of the mold by suction of air in the inner section of the male paper manufacturing mold 20 having the above shape by using a vacuum pump 24.

(b) In the dehydration and molding step, the male paper manufacturing mold 20 in that state is lifted from the pulp dissolving fluid 23 and the female paper manufacturing mold 21 is compressed. By further suction with the vacuum pump 24, water in the pulp which has adhered during the previous step is removed and the product is shaped.

(c) In the drying step, the mold is maintained in a compressed state and the product is heated and dried by a high temperature heat source such as an electrical drier which is provided in the male-female mold. After completion of the drying process, the mold is opened and the product is removed.

If the manufacture of speaker frames conventionally made from resin molding by injection molding apparatus, or by zinc casting by a casting machine or by metal plate pressing with a metal pressing machine is changed to fine pulp molding, not only are the above advantages obtained, but also advantages with respect to acoustic characteristics and material recycling as outlined below are also obtained.

Generally the self-resonance frequency of paper of equal surface area and equal thickness is known to be lower than the corresponding frequency for metal.

As described above with respect to the prior art, a speaker with an aperture of 13 cm and an aluminum frame of 0.7 cm thickness has a self-resonance frequency in the vicinity of 1.5 KHz. When a paper frame with an equal aperture and a thickness of approximately 2 mm formed by fine pulp molding is used, the self-resonance frequency has been confirmed on the basis of experimental observation to be reduced to the vicinity of 250 Hz.

In this way, since paper reduces the self-resonance point as a result of large internal loss in comparison with metal, it is possible to obtain a speaker with reduced noise on an audible level.

A further advantage is that paper is a non-magnet substance. Steel frames apply a magnetic flux to the frame from the magnetic circuit since the frame is a strongly magnetic body. That is to say, it is not possible to ignore flux leakage which is one reason for reductions in the effectiveness of the device. On the other hand however, a paper frame entails no such considerations.

In comparison to the recycling of a metallic member, speakers using a frame formed by fine pulp molding can be easily separated or dismantled. For example, heating the overall speaker unit to an ignition temperature for paper allows only paper sections to be burnt and metallic members only removed.

Furthermore if the entire speaker is placed in water for a fixed time, the frame will change into a pulp solution. In this way, easy of disassembling or dismantling allows costs for the recycling of paper frames to be held to low levels.

Disposal by way of burying, for example in simple land fills, can be advantageously used for paper frames in comparison with other materials. The decomposition of paper in earth is completed in a short period of time by bacteria as is the case with timber. This equals a low effect on the environment. On the other hand, steel frames take a long time in comparison with paper frames and resin frames are almost impervious to decomposition even after the passage of extremely long periods of time.

The present invention relates to fine pulp molding which is an excellent processing method and material for the frames of speakers as discussed above. However for the reason detailed below, such processing has not been carried out.

Fine pulp molding entails the compressing and heating of plant fiber which is dissolved in an aqueous solution and flows onto a mold. Thus problems with respect to the dimensional accuracy of the product which are typically associated with metal pressing or resin molding are avoided.

A speaker requires metallic members comprising a magnetic circuit such as an upper plate and a bottom plate apart from the frame. These are secured and maintained at a fixed accuracy to a fixed position on the frame. For example, a plurality of slits 1*b* of a required accuracy must be provided on an upper face of the frame.

Since fine pulp molding of itself does not obtain an accurate outer shape or a required accuracy for the interval between mutual holes or the hole radius, secondary processing has been used in conjunction with fine pulp molding as an auxiliary means.

Shear processing by pressing becomes increasingly difficult with increases in the cross sectional thickness of paper material. Many pulp fibers which are mutually matted in shear surface cross section are not easily ruptured and as a result, a clear cut cross section is not obtained Thus when shear processing is conducted on a mass production basis, wear on apparatus such as cutting dies is increased and the cut face becomes increasingly coarse.

In consequence, the time required for maintenance and preparation of apparatus increases which at the same time reduces productivity. When pulp consisting of long length fibers is used, the above tendency is particularly pronounced. The most conspicuous difference between press shear processing of paper and shear processing of metal plate resides in this point. It is necessary to address this poor processing efficiency in order to produce speaker frames with fine pulp molding.

The problem of frame strength has also arisen with respect to extreme environments. Speakers for use in general household audio-visual appliances are sufficiently strong, however it is believed that frame strength is deficient in environments with high temperature and humidity or high levels of vibration such as vehicle mounted audio products for example.

As discussed above, specific advantages and disadvantages exist for the quality of frames for use in speakers and many problems remain to be solved with respect to sound quality, cost, reliability, recycling of materials and disposal processing.

SUMMARY OF THE INVENTION

The present invention is proposed to solve the above problems and has the object of providing a frame for use in speakers which, as a result of improvements to the fine pulp molding manufacturing process, realizes excellent sound quality at a low cost, which allows recycling of materials and which reduces effects on the environment due to facilitating disposal.

(1) The speaker device of the present invention proposes a speaker which forms a frame from pulp by a paper manufacturing process. A peripheral section of the shear processed section of the frame is carbonized and shear processing is then applied to the carbonized section.

(2) The speaker which forms a frame from pulp by a paper manufacturing process provides sections which are selectively heat pressed and sections which are selectively not heat pressed in the frame. At least a peripheral section to a mounting hole provided in the frame is designated as a section which is not heat pressed.

(3) A speaker which forms a frame from pulp by a paper manufacturing process embeds at least one section of an auxiliary strengthening member in a peripheral section of a mounting hole on the frame and mounts the auxiliary strengthening member on a peripheral section of a mounting hole.

(4) The speaker which forms a frame from pulp by a paper manufacturing process embeds at least one section of the upper plate in the frame and mounts the upper plate on the frame.

(5) The speaker which forms a frame from pulp by a paper manufacturing process forms an electrically insulated section by impregnating an insulating medium such as an insulating oil at least into the terminal mounting section of the frame and mounts the terminal.

(6) The speaker which forms a frame from pulp by a paper manufacturing process is composed of pulp and a material which comprises biodegradable fiber having a relative density near that of pulp.

DETAILED DESCRIPTION OF THE PREFERRED EMBODIMENTS

Embodiment 1

The invention according to embodiment 1 comprises a peripheral section of the shear processed section of the frame being carbonized to facilitate shear processing. Thus during manufacturing of a frame by fine pulp molding, shear processing by pressing is facilitated as a result of the above carbonizing processing.

During a series of processes comprising pulp molding as discussed above with respect to the prior art, a drying process is provided which presses a heated metal mold into pulp, which has been by molded by the heating and dehydration of water in the pulp. The mold temperature during this process is normally in the vicinity of 250 degrees.

Figures 1A, 1B, 1C, 1D:
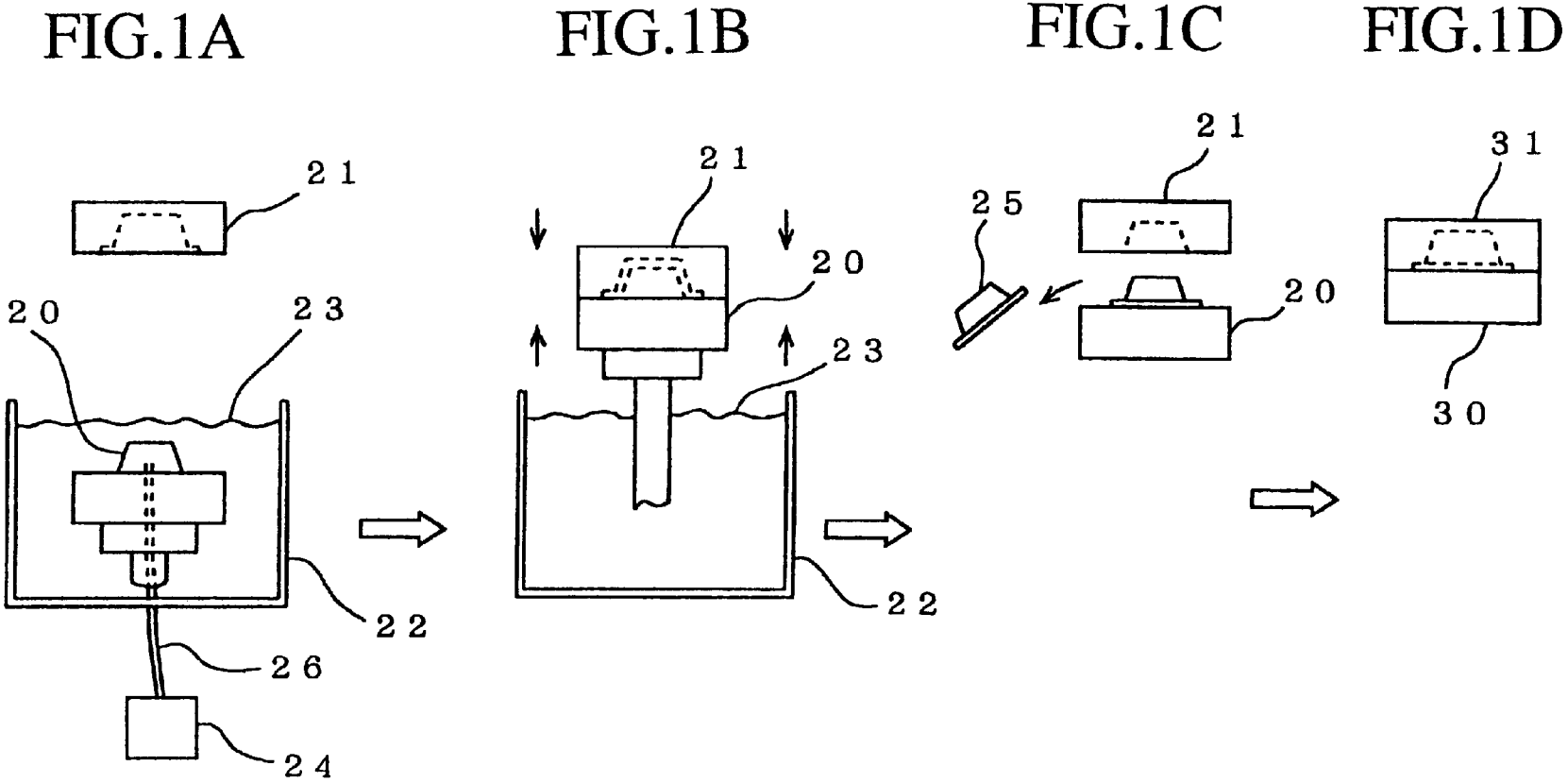
FIG. 1A–1D is a schematic view of a carbonizing step added to the paper manufacturing, molding steps of fine pulp molding according to a first embodiment of the present invention.

The present invention adds a carbonizing process after the drying process. FIG. 1 is a model diagram provided to illustrate the above point.

Figure 2:
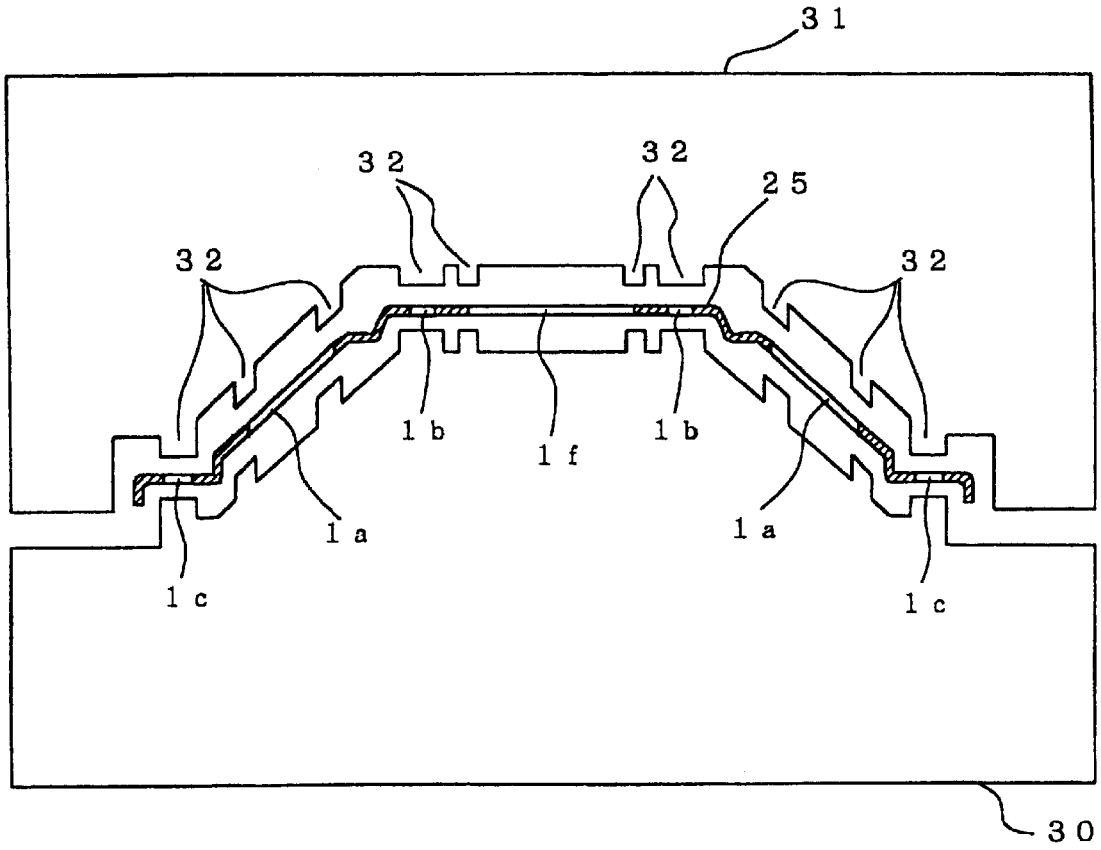
FIG. 2 is a schematic view of a molded article and mold used in a carbonizing step of fine pulp molding according to a first embodiment of the present invention.
Figure 13A:
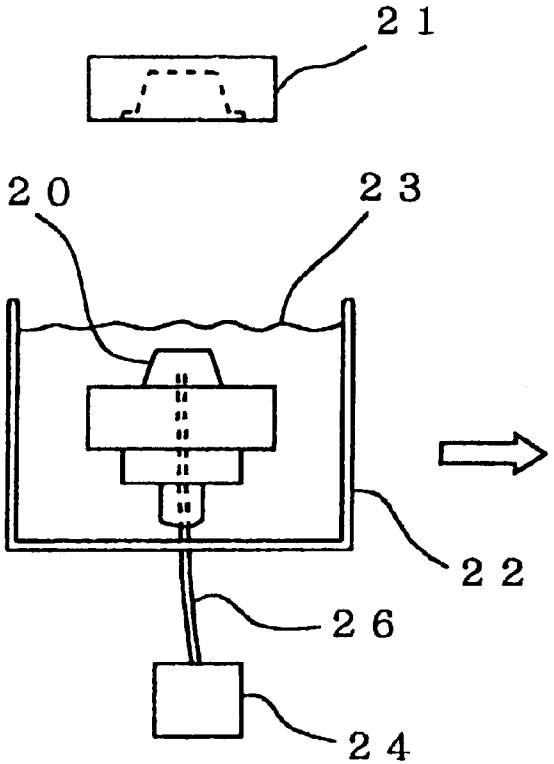
FIG.13A (PRIOR ART)
FIG. 13A–13C is a schematic view showing the paper manufacturing and molding steps in conventional fine pulp molding.
Figure 13B:
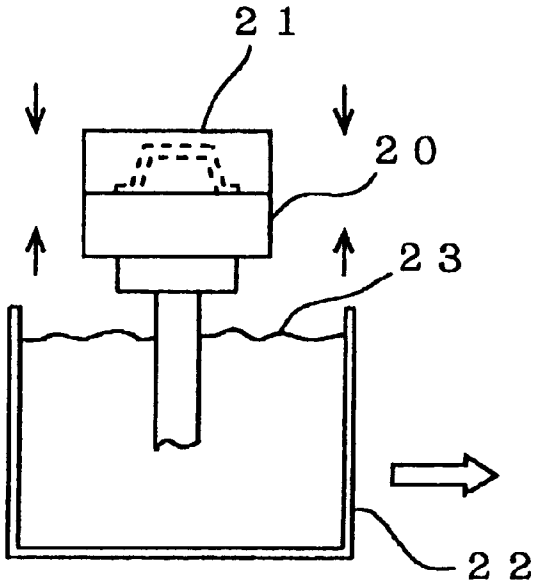
FIG.13B (PRIOR ART)
Figure 13C:
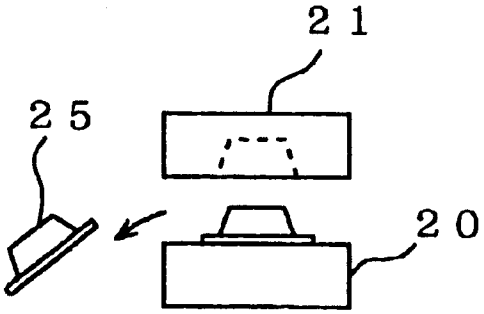
FIG.13C (PRIOR ART)

In FIG. 1, although (a), (b), (c) correspond to steps as shown in FIG. 13, the present invention differs in that a carbonizing process (d) is further added as shown in FIG. 2.

In FIG. 2, reference numeral 30 denotes the male carbonizing metal mold of the present invention. 31 denotes the female carbonizing metal mold of the present invention. In the present invention, products obtained in the drying process are thereupon transferred to the carbonizing metal mold and heated. FIG. 2 is a model diagram showing an example of a carbonizing metal mold.

The shape of male/female metal mold in this process is formed in a protrusion only in a fixed range about a position which is required for shear processing of the frame. Only the protrusion abuts with the frame. In other sections, that is to say, at positions at which shear processing is not required, the metal mold is in the shape of an indentation and is adapted not to abut with the frame.

Molded products 25 of the pulp mold are pressed and heated by the male and female carbonizing metal mold 30, 31. For example, only the protruded section of the heating mold 32 abuts with the peripheral section of the window 1*a* or the peripheral section of the slit 1*b*. A source of heat is provided on an inner section of the section of the heating mold 32, and the metal mold temperature at the abutting section is maintained at a temperature which carbonizes paper.

Figure 3:
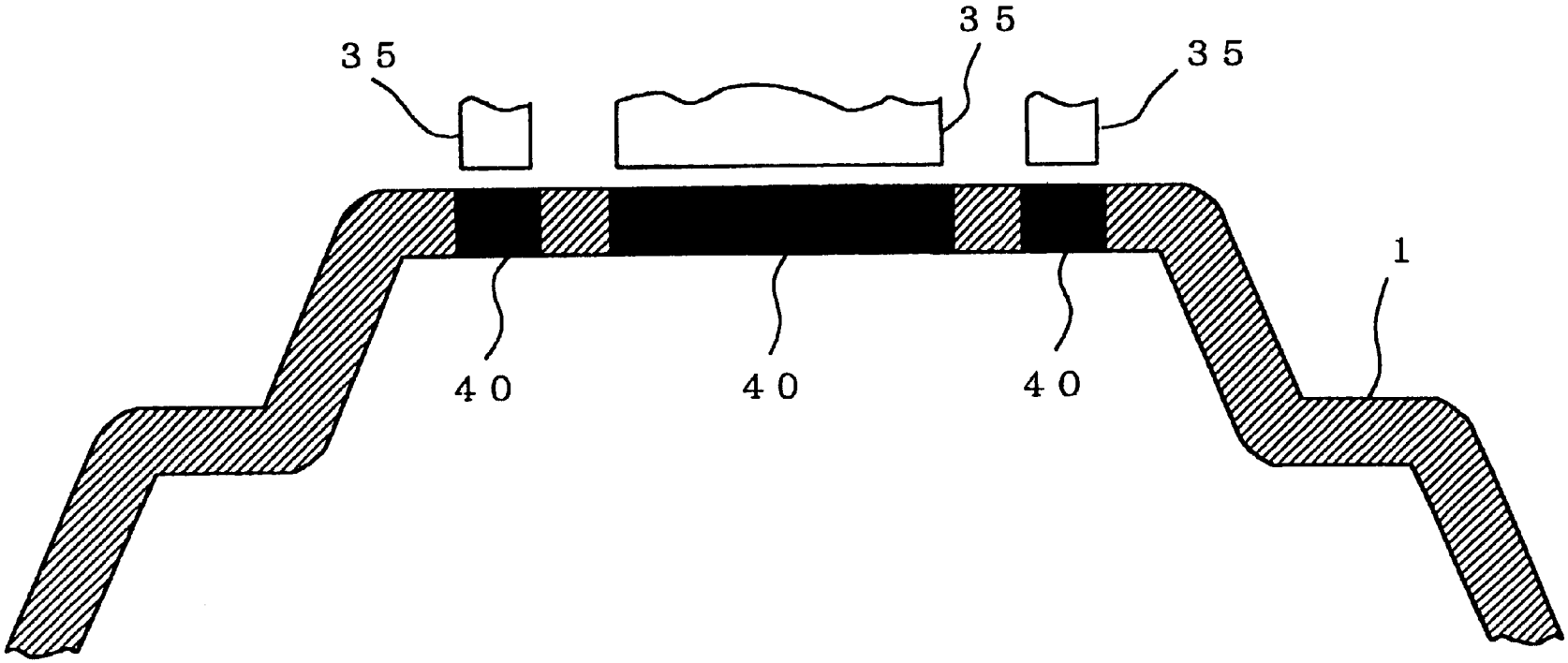
FIG. 3 is a cross sectional schematic view of a carbonized layer formed in a frame according to a first embodiment of the present invention.

In such a way, if a determined section is selectively heated to a high temperature, only pulp fibers in a section which abuts with the metal mold are carbonized. Their structure becomes minute with the result that such fibers lose fiber qualities. FIG. 3 is a cross sectional schematic figure of a frame undergoing such a process. A carbonized layer 40 is formed which is carbonized in the frame by the process discussed above.

Figure 4:
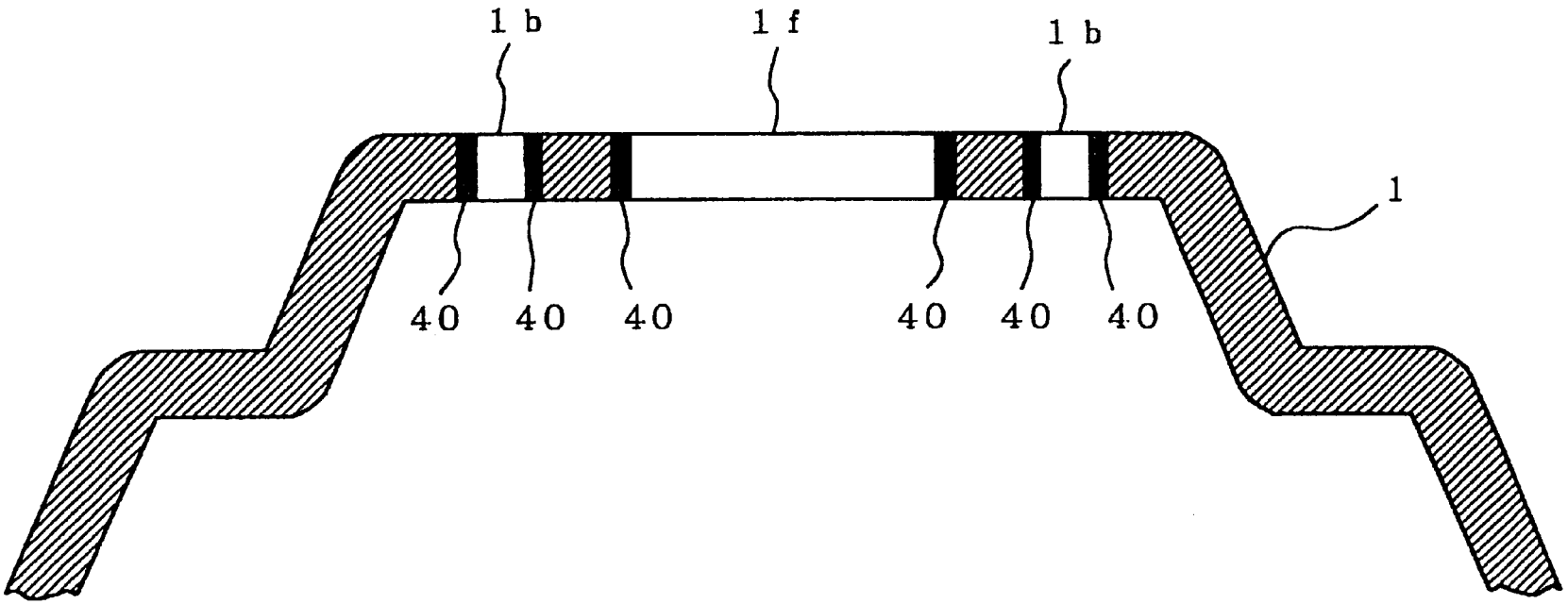
FIG. 4 is a cross sectional schematic view of a frame according to a first embodiment of the present invention.

The application of press shear processing with a cutting die 35 at such carbonized positions displays an ease which is similar to the shear processing of metal. FIG. 4 is a cross sectional schematic figure showing an example of a frame after the completion of shear processing. In the figure, for example, a large section of the carbonized layer 40 has detached and fallen and the slit 1*b*, and the hole 1*f* provided for the pole piece have been formed.

FIG. 2 shows a local heating mold 32 for carbonizing heating provided near a female carbonizing metal mold 31. However a local heating mold 32 may also be provided near a male carbonizing metal mold 30 and heated from above and below.

As shown above according to a first embodiment, when a frame formed from pulp undergoes press shear processing during secondary processing, peripheral sections to the processed section are carbonized and lose qualities pertaining to paper fiber. Thus the application of shear processing to the carbonized sections obtains a shear cross sectional surface with minute structure, improves the effectiveness of the processing, decreases wear on apparatus and obtains a frame with high efficiency.

Embodiment 2

The invention according to embodiment 2 comprises an effect of avoiding strain by the formation of the peripheral section of the mounting hole of the frame with a flexible structure.

In contrast to embodiment 1, the second embodiment is not adapted to pressure determined sections. A slight gap is provided on the molded product surface and the metal mold. If the mold pressure on the molded product surface is reduced, it is possible to produce a flexible surface selectively only on that section.

The pulp in the section which is not heat pressed is near to a naturally dried state which has not been heat pressed. Thus the interval between adjacent pulp fibers is wide and the structure is coarse. That is to say, flexibility is comparatively high in comparison with sections which are heat pressed.

Thus in such a case, the carbonizing process need not be applied.

For example when a speaker is mounted in a vehicle door or on a rear shelf, the speaker frame is fixed by a strain, when there is a strain on the mounting surface in the vehicle. This extends to the mechanical displacement of the diaphragm and the damper. As a result, linear movement of the diaphragm is hindered and oscillation of the diaphragm is limited which may result in an acoustic strain.

The axial center of vibration undergoes a large displacement and the voice coil 5*a* comes into rubbing contact with the upper plate 2 of a magnetic body such as iron. Thus the insulating coating of the coil wires is destroyed and an interlayer short circuit is generated. The rated impedance is extremely reduced and may result in overheating of the speaker.

Figure 12:
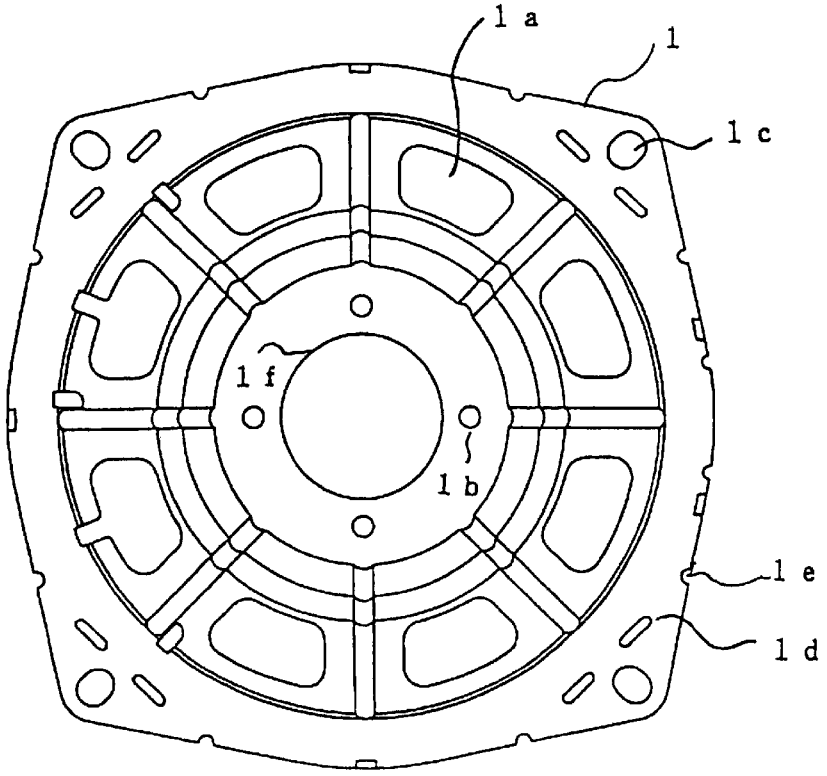
FIG.12 (PRIOR ART)
FIG. 12 is a plan view showing a frame of a speaker unit using conventional thin metal plate.

In order to avoid the problems in the prior art, a strain absorption notch 1*e* and a strain adsorption hole 1*d* as shown in FIG. 12 are provided in the metallic frame for example. These are comprised by a slit shaped hole which is provided in proximity to the speaker mounting hole 1*c* and a notch provided on an outer section on a line extended in the longitudinal direction on the frame 1. It is noted that these holes are formed by pressing during secondary processing.

When a bolt or a screw is inserted into the speaker mounting hole 1*c* and fixed in a complimentary member, even when a stress exists with respect to the mounting surface, the frame 1 deforms and bends along the line connecting the strain absorption notch 1*e* and a strain adsorption hole 1*d* and thus the strain does not extend to the central section of the frame.

Figure 5:
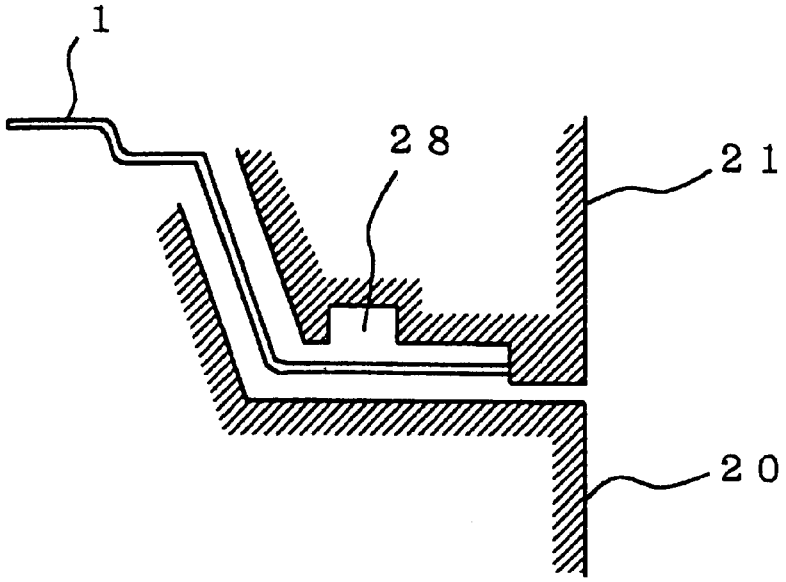
FIG. 5 is a cross sectional schematic view of a female paper manufacturing mold according to a second embodiment of the present invention.

The frame of the present invention affords the same function as that discussed above with a paper manufacturing or molding process. FIG. 5 shows an example of the process.

In FIG. 5, a frame 1 is sandwiched between a male paper forming mold 20 and a female paper forming mold 21. A slight indentation 28 is provided on a section of the female paper-forming mold 21. If the mold is adapted not to abut with the frame 1, that section which does not abut will not be heat pressed during the drying process and thus will remain at a low pressing pressure.

Since the internal structure of the pulp is a coarse, flexible structure if not pressured, it is possible to create a flexible structure in the frame. If a non-heat pressed section is provided in proximity to the speaker mounting hole 1*c*, a structure which absorbs strain without a separate secondary processing step is possible.

As shown above according to the second embodiment, a section which is not heat pressed is selectively provided on the surface of a frame which is formed from paper and thus it is possible to maintain a flexible section with low rigidity. Therefore if applied to a peripheral section of the mounting hole of a speaker, a paper frame is created in which strain on the mounting surface due to fixation with a threaded member does not extend to vibrating elements.

Embodiment 3

Embodiment 3 of the present invention allows reinforcement of a peripheral section of a mounting hole.

For example when a speaker is mounted in a vehicle undergoing a large amount of vibration or a vehicle which runs largely on unsealed roads, it is often necessary to increase the fixing torque of mounting screws or to insert a spring washer to fix the screws in order to prevent loosening of screws due to vibration.

In such cases, since a paper frame such as one manufactured by fine pulp molding has low compressive strength, the danger exists that the material will deteriorate or be ruptured by the fixing torque.

Figure 6:
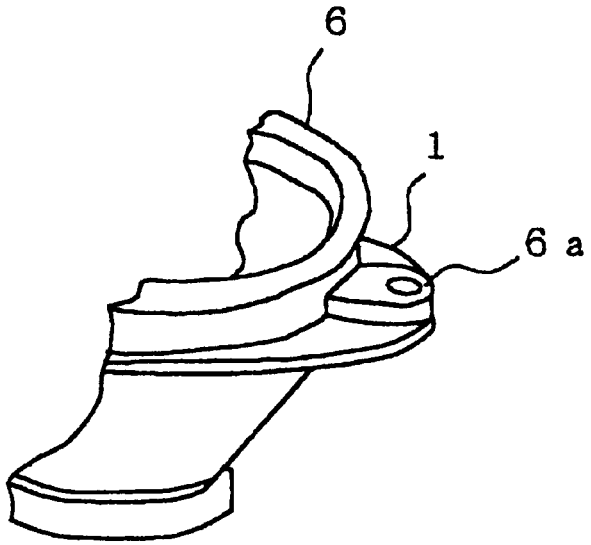
FIG. 6 is a perspective view of a conventional reinforcing member.

As shown in FIG. 6, a method of reinforcing which is often used in the conventional frame in this situation comprises the provision of a resin gasket 6 and an integrally formed reinforcing member 6*a* in the mounting hole or a peripheral section thereto. In such a way, the fixing pressure of the screw is applied to the reinforcing member rather than to the frame. Needless to say, the same method may be applied to paper frames.

However the material used in the formation of the speaker gasket is not always resin and paper tubing comprising laminated paper in pineapple shaped sections are used due to their low cost. Alternatively another typical example is the use of a plurality of stamped laminated paper sections adhered to the frame. Furthermore examples of omitting the gasket itself exist and such examples display diverse methods. Thus a method of reinforcing is desirable which is not limited by the material or the shape of the gasket.

Figure 7:
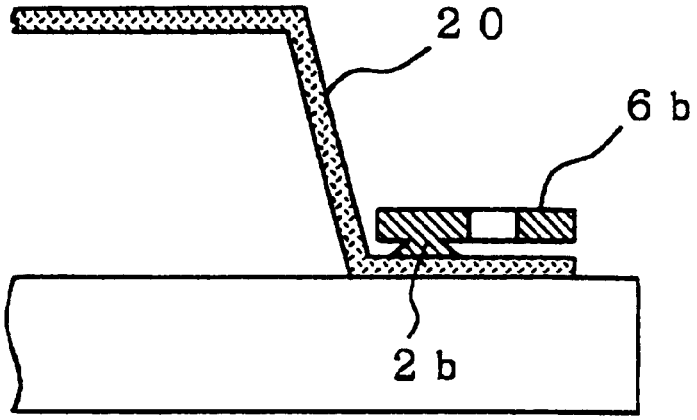
FIG. 7 is a cross sectional schematic view for forming a reinforcing piece by insertion molding according to a third embodiment of the present invention.

An embodiment which solves the above problems is shown in FIG. 7.

In FIG. 7, a reinforcing piece 6*b* is predisposed at a fixed position of the male paper manufacturing mold formed by metal wire. An inverted conical anchor 2*b* is provided on the reinforcing piece 6*b*. The material of the reinforcing piece 6*b* may be resin or metal.

Figure 8:
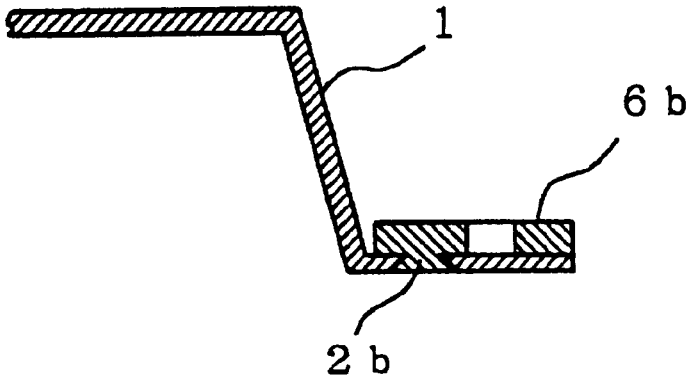
FIG. 8 is a cross sectional schematic view of a frame provided with a reinforcing piece according to a third embodiment of the present invention.

In this state, the paper manufacturing and molding process is completed during the pulp dissolved solution, a product (frame 1) with a cross sectional face as shown in FIG. 8 is obtained. Since the inverted conical anchor 2*b* is attached to the frame 1, there is no danger of detachment.

When pulp is vacuum sucked in the pulp dissolved solution thereafter, the pulp adheres to the paper manufacturing mold about the reinforcing piece and the reinforcing piece is thus buried in the pulp. Molding is completed in the same way as insertion molding by resin molding. The provision of a plurality of anchors 2*b* on the reinforcing piece 6*b* maintains fixation to the pulp layer after molding and prevents detachment.

As shown above according to Embodiment 3, since a reinforcing piece comprising a separate member is buried in a peripheral section to the mounting hole of a frame formed by pulp in the paper manufacturing process, a speaker with excellent mounting rigidity is obtained without the necessity to perform secondary processing such as adhesion.

Embodiment 4

In embodiment 4 of the present invention, an upper plate is embedded in the frame when the upper plate is mounted on the frame.

In embodiment 3 above, an example of inserting a reinforcing piece for reinforcing of a mounting hole was discussed. However it is possible to insert a metallic member such as an upper plate for example by a similar method.

Figure 11:
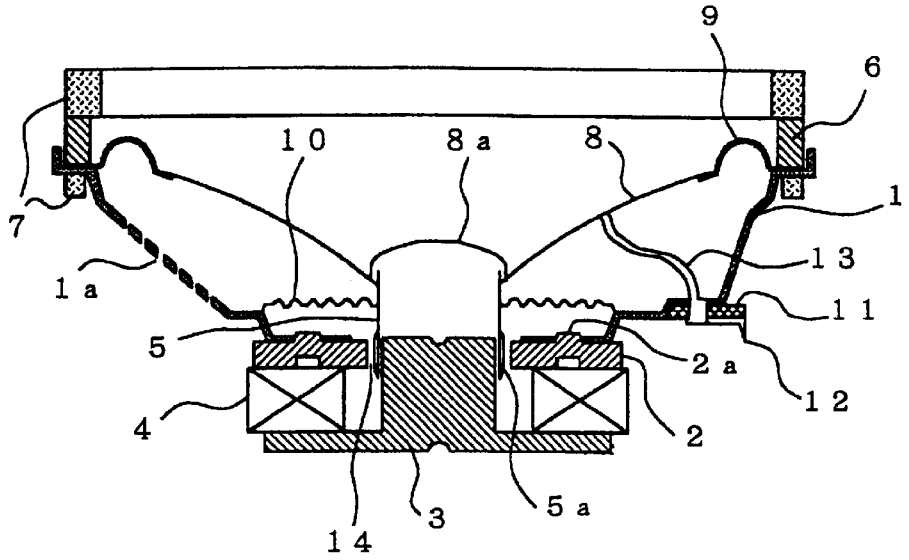
FIG.11 (PRIOR ART)
FIG. 11 is a cross sectional schematic view showing the structure of a speaker unit using conventional metal plate.

Spot welding or caulking are often used in the fixation of an upper plate to the frame during a speaker manufacturing process. Caulking is a processing method whereby a plastic deformation is created in metal by pressure or impacting and thus fine metallic powder is generated during the process. When this metallic powder is an iron powder, the powder adheres to an air gap 14 as shown in FIG. 11.

This is as a result of the air gap 14 having a high magnetic density. Furthermore as the air gap 14 is in proximity to the section which is undergoing caulking, magnetic bodies adhere easily. The air gap 14 is a narrow space formed by the adjacently disposed pole piece 3 and the plate 2. The voice coil 5*a* undergoes reciprocating motion in the space. The adhering of the iron powder results in the fact that iron powder exists in the space.

Thus the possibility of damage due to the iron powder adhering exists as a result of the insulating coating of the coil being destroyed by the friction between the powder and the reciprocating voice coil 5*a* and an interlayer short circuit being produced. Alternatively, this may result in audible abnormal sound quality being produced as a result of strain. It is noted that a majority of malfunctions in the manufacturing of speakers are attributable to iron powder adhering to the air gap.

If an upper plate is insertion molded into a frame by fine pulp molding, a caulking process which is the principal cause of the generation is iron powder is not required. Thus it is possible to reduce malfunctions during speaker manufacturing processes and to reduce manufacturing costs.

Figure 9:
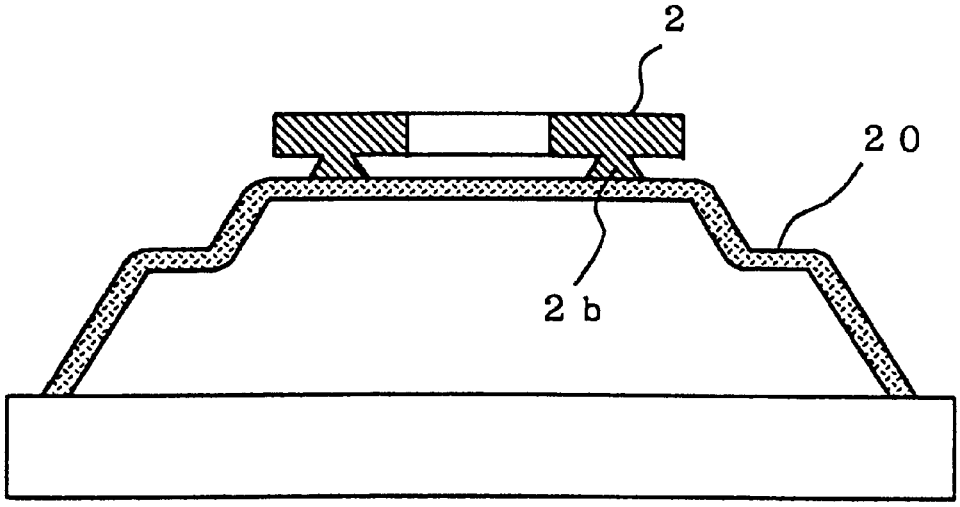
FIG. 9 is a cross sectional schematic view for forming an upper plate on the frame by insertion molding according to a fourth embodiment of the present invention.

FIG. 9 shows this embodiment of the invention.

Figure 10:
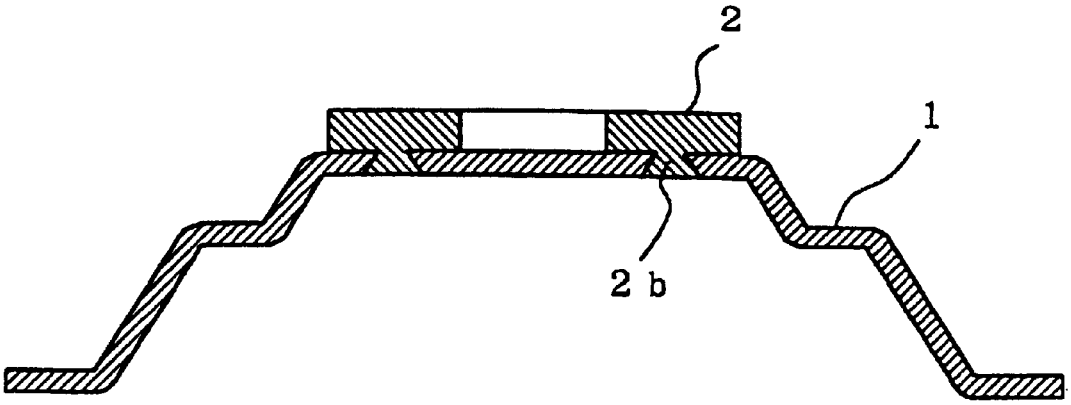
FIG. 10 is a cross sectional schematic view showing products obtained by insertion molding of an upper plate on the frame according to a fourth embodiment of the present invention.

In FIG. 9, an upper plate 2 is positioned at a fixed position in a male paper manufacturing mold 20 formed from metal wire. A slit 1*b* is not formed in the upper plate and instead an inverted conical anchor 2*b* is formed. In this way, on the completion of paper manufacturing and molding, a product with a cross sectional face such as that shown in FIG. 10 is obtained. Furthermore since the inverted conical anchor 2*b* is attached to the frame 1, there is not danger of detachment.

As shown above according to embodiment 4, since an upper plate is insertion molded in a paper manufacturing process to a frame, caulking or welding process which generate fine iron powder are not required. Thus a speaker is produced which has low amounts of metallic powder adhered to a magnetic gap. The adhering of such powder has constituted the major reason for interlayer short circuiting in the voice coil and the generation of abnormal sounds.

Embodiment 5

In embodiment 5 of the present invention, the impregnation of an insulating oil in a peripheral section of a terminal mounting section of at least the frame obviates the need for the provision of a terminal board.

Normally a terminal or a connector is provided on the frame of a speaker as an electrical connection point for the input of a signal from an electrical amplifier. When the material constituting the frame is metal, firstly a terminal board is fixed to an insulating body on the frame and then the metallic terminal is provided on the terminal board. When the frame is molded by fine pulp molding, it is possible to use the frame itself as an insulating body in the manner outlined below.

A frame molded by fine pulp molding comprises compressed and dried pulp fiber. Thus when dried, the material has electrical insulating characteristics. However such characteristics can be reduced by the absorption of humidity. In order to avoid such a situation, the impregnation of an insulating oil prevents any effect on electrical insulating characteristics due to the absorption of moisture from the air. Frames molded by fine pulp molding can easily introduce an oily liquid by capillary action.

The terminal can be simply provided by impregnating the insulating oil is impregnated into a fixed position in the frame and fixing the metallic terminal to the impregnated section. That is to say, a terminal board which acts as an indispensable insulating member in a metallic frame can be dispensed with. As a result of the insulating member being dispensed with, manufacturing costs are reduced.

An insulating oil has been impregnated in a section of the frame in the example given above. However needless to say, the same effect may be obtained by impregnating the entire frame with the insulating oil. The impregnating medium is not limited to insulating oil and for example may include types of liquid high polymers with characteristics allowing the permeation of paper.

Media with high molecular weights which do not readily impregnate paper may be impregnated in low polymer form and thereafter converted into high polymers by polymerization on the application of heating to the entire frame.

It deserves special mention that the oil component of the insulating oil or the like which impregnates the entire frame enables humidity resistance and water proofing qualities in addition to such electrical insulating qualities. On the other hand, when a polymer is formed instead of an insulating oil, it is possible to increase mechanical strength by improving rigidity by the use of materials related to resins. As a result, the advantage can be obtained of improving the mechanical strength which has been generally noted as a disadvantage of the use of paper.

In accordance with embodiment 5 above, since an insulating oil is impregnated into a section or the entirety of a frame molded from pulp, the impregnated section displays electrical insulation. Thus a speaker may be provided economically with the function of the insulating terminal board being performed by the frame itself.

Embodiment 6

In the present invention according to embodiment 6, pulp and biodegradable fiber are mixed, and mechanical strength is thus increased. At the same time, such a frame has increased biodegradability even when buried in a land fill during a disposal process.

In order to increase the rigidity of a frame made from a fine pulp molding process by a means other than impregnation, resin with a specific gravity approximately equal to plant fiber is mixed in a pulp solution in fibrous form (hereafter simply referred to as resin fiber) and thereafter it is possible to form a mixture with plant fiber.

The reason for selecting a resin fiber with a specific gravity approximately equal to plant fiber is that, when a large discrepancy exists with the specific gravity of plant fiber, one of the components sinks in the pulp and fiber mixture and hinders the formation of an evenly dispersed mixture. Thus if both components have an approximately equal specific gravity, an extremely equal mixture may be obtained.

It is preferred that the specific gravity is approximately equal, however a ratio of both values for the specific gravity which slightly differs by 1:1.5 is acceptable. That is to say, the specific gravity need only be similar.

If a substance having bio-degradable characteristics is selected as a resin fiber, an advantage for example of increasing the mechanical strength of the frame as represented by the rigidity is achieved. Furthermore when the frame is disposed of by burying in the earth or in water, low polymer compounds are decomposed by micro-organisms existing in the natural world in the same timeframe as plant pulp.

As shown above according to embodiment 6, since a bio-degradable fiber with a specific gravity close to that of pulp is mixed in the pulp as a frame material, a frame is provided with increased mechanical strength and allows rapid bio-degrading when buried in earth on disposal.

The present invention is adapted to carbonize a peripheral section of the shear processed section of the frame. Thus the shear processed section is strengthened, a shear cross section with minute structure is obtained and a speaker with a highly accurate frame is obtained.

The present invention is adapted to preserve at least a section in the periphery of a mounting hole in the frame as a section to which heat pressing is not applied. Thus a flexible low rigidity section is maintained. When the frame is mounted, low levels of strain are produced with respect to the mounting surface as a result of the fixing of a threaded member and a frame for a speaker is produced in which such strain does not reach vibrating elements.

The present invention is adapted to mount and bury a reinforcing member in a peripheral section to a mounting hole of the frame. Thus a speaker is obtained with excellent mounting rigidity without the need to perform secondary processing such as adhesion.

The present invention is adapted to mount and bury an upper plate in a frame. Thus welding or caulking g operations which generate metallic powder are not required and a speaker is obtained which has low amounts of metallic powder adhered to a magnetic gap which constitutes the main cause of interlayer short circuit in the voice coil or the production of abnormal sounds.

The present invention is adapted to form an electrical insulating section by the impregnation of an insulating medium such as an insulating oil into a terminal mounting section of at least the speaker and to mount the terminal. Thus as a terminal board is not required, a speaker with reduced manufacturing costs is produced.

The present invention is adapted to use a frame material of pulp containing a biodegradable fiber with a specific gravity close to that of pulp. Thus a frame for a speaker with increased mechanical strength is produced. Disposal even including burying in land fills is facilitated due to the biodegradability.

What is claimed is:

1. A speaker frame comprising dried paper pulp and at least one slit or hole, the speaker frame being formed by a process of:

molding the paper pulp;

drying the paper pulp;

carbonizing at least one peripheral section of said speaker frame; and shear processing, whereby the at least one slit or hole is formed.

2. The speaker frame according to claim 1, wherein the speaker frame has mounting holes, and a peripheral section of at least one of said mounting holes is provided as a section which has not been carbonized.

3. The speaker frame according to claim 2, wherein an auxiliary strengthening member is mounted at a peripheral section of at least one of the mounting holes.

4. The speaker frame according to claim 1, wherein an upper plate is embedded in the speaker frame.

5. The speaker frame according to claim 1, further comprising at least one terminal mounting section, the terminal mounting section being formed with an electrically insulating section by impregnating an insulating medium comprising an insulating oil.

6. The speaker frame according to claim 1, wherein the frame contains biodegradable fiber.

7. The speaker frame according to claim 1, wherein the molding step is performed by immersing a male mold in wet pulp and adhering the pulp to the mode using vacuum suction.

8. The speaker framed according to claim 7, wherein the drying step is performed by pressing a female mold to the pulp on the male mold.

9. The speaker frame according to claim 1, wherein the carbonizing is performed using a carbonizing mold.

10. The speaker frame according to claim 9, wherein the carbonizing mold comprises a male carbonizing mold and a female carbonizing mold.

11. The speaker frame according to claim 9, wherein the carbonizing mold contains a protrusion corresponding to each of said positions to be carbonized.

12. The speaker frame according to claim 1, wherein the pulp comprises plant fiber and resin fiber having a specific gravity approximately equal to that of the plant fiber.

13. The speaker frame according to claim 1, wherein the pulp comprises plant fiber and resin fiber, and a ratio of the specific gravity of the plant fiber and the resin fiber varies from 1 to 1.5.

14. The speaker frame of claim 1, wherein the shear processing is performed using a cutting die.

* * * * *